US008357268B2

(12) United States Patent
Pietzner et al.

(10) Patent No.: US 8,357,268 B2
(45) Date of Patent: Jan. 22, 2013

(54) SYSTEM FOR DRIVING AND CONTROLLING A MOVABLE ELECTRODE ASSEMBLY IN AN ELECTROCHEMICAL PROCESS TOOL

(75) Inventors: Michael Pietzner, Dresden (DE); Mario Illgen, Dresden (DE); Kerstin Siury, Dresden (DE); Frank Kuechenmeister, Dresden (DE)

(73) Assignee: Advanced Micro Devices, Inc., Austin, TX (US)

( * ) Notice: Subject to any disclaimer, the term of this patent is extended or adjusted under 35 U.S.C. 154(b) by 1518 days.

(21) Appl. No.: 11/861,689

(22) Filed: Sep. 26, 2007

(65) Prior Publication Data

US 2008/0156641 A1 Jul. 3, 2008

(30) Foreign Application Priority Data

Dec. 29, 2006 (DE) ..... 10 2006 062 031

(51) Int. Cl.
*C25F 7/00* (2006.01)
*C25D 17/00* (2006.01)

(52) U.S. Cl. ..... 204/224 M; 204/224 R; 205/651

(58) Field of Classification Search ..... 204/224 R, 204/224 M; 205/651
See application file for complete search history.

(56) References Cited

U.S. PATENT DOCUMENTS

| | | | | |
|---|---|---|---|---|
| 5,543,032 | A * | 8/1996 | Datta et al. | 205/670 |
| 7,775,853 | B2 * | 8/2010 | Jeong et al. | 451/8 |
| 2002/0049029 | A1 * | 4/2002 | Large et al. | 451/288 |
| 2003/0060143 | A1 * | 3/2003 | Birang et al. | 451/51 |
| 2004/0134774 | A1 * | 7/2004 | Woodruff et al. | 204/222 |
| 2005/0115838 | A1 | 6/2005 | Mori et al. | |
| 2005/0253576 | A1 * | 11/2005 | Nyce | 324/207.17 |
| 2006/0289298 | A1 | 12/2006 | Kobata et al. | |

FOREIGN PATENT DOCUMENTS

| | | | |
|---|---|---|---|
| DE | 10241619 | B4 | 7/2004 |
| DE | 102005009024 | A1 | 9/2006 |

OTHER PUBLICATIONS

Translation of Official Communication from German Patent Office for German Patent Application No. 10 2006 062 031.3-34 dated Aug. 27, 2007.

* cited by examiner

*Primary Examiner* — Nicholas A. Smith
(74) *Attorney, Agent, or Firm* — Williams, Morgan & Amerson, P.C.

(57) ABSTRACT

By providing an enhanced drive system for electrochemical etch process tools, the operational range, as well as the reliability, may be enhanced. For this purpose, a high torque electric motor may be used in combination with an appropriate power transmission, which may be attached to a corresponding tool frame at a height level that is above a corresponding height level at which respective chemicals are provided to the substrate under process. Hence, the probability for contamination by chemicals may be significantly reduced, thereby also reducing maintenance efforts resulting in reduced production costs.

19 Claims, 7 Drawing Sheets

SYSTEM FOR DRIVING AND CONTROLLING A MOVABLE ELECTRODE ASSEMBLY IN AN ELECTROCHEMICAL PROCESS TOOL

BACKGROUND OF THE INVENTION

1. Field of the Invention

Generally, the present disclosure relates to the electrochemical treatment of a surface of a substrate used for forming microstructural features, such as circuit elements of integrated circuits, using a reactor and a movable electrode or fluid application assembly, wherein the surface to be treated is scanned in a linear motion.

2. Description of the Related Art

In many technical fields, the electrochemical treatment of a substrate surface, such as the deposition of metal layers on and/or the removal of metal from the substrate surface, is a frequently employed technique. For example, for efficiently depositing relatively thick metal layers on a substrate surface, plating, in the form of electroplating or electroless plating, has proven to be a viable and cost-effective method and, thus, electroplating has become an attractive deposition method in the semiconductor industry. Similarly, the removal of metal from exposed substrate surfaces is frequently performed on the basis of an electrochemical treatment, which is also referred to as electrochemical etching.

Generally, electrochemical deposition or removal of metals, such as electroplating or electrochemical etching, may be accomplished on the basis of an appropriate electrolyte containing respective metal ions that are electrically neutralized at the substrate surface, which may act as the cathode, thereby resulting in a deposition of metal atoms on the electrically negative surface. The amount of metal deposited is proportional to the current flowing through the electrolyte according to Faraday's law. Similarly, during electrochemical etching, the substrate surface may act as a consumable anode, wherein the metals of the substrate surface that are in contact with the electrolyte solution are ionized and dissolved into the solution. The corresponding metal ions may, depending on the chemistry of the metal and the salt in the solution, deposit on a respective cathode, as previously described with respect to the electrochemical deposition, fall out as precipitate or stay in the solution.

During the last decade, copper has become a preferred candidate for forming metallization layers in sophisticated integrated circuits, due to the superior characteristics of copper and copper alloys in view of conductivity and resistance to electromigration compared to, for example, the commonly used aluminum. Since copper may not be deposited very efficiently by physical vapor deposition, for example by sputter deposition, with a layer thickness on the order of 1 μm and more, electroplating of copper and copper alloys is presently a preferred deposition method in forming metallization layers. Using the copper damascene approach, that is, forming metallization layers by filling vias and trenches previously patterned into a dielectric layer with metal on the basis of an electrochemical deposition process, much experience has been gained in the field of semiconductor manufacturing with respect to electrochemical processes and chemistries. It has been recognized that the electrochemical processes may have the potential of applicability in many other opportunities in the field of semiconductor manufacturing. Thus, in addition to metal deposition using electrolytic and/or electroless processes, electrochemical etching, electrophoretic deposition, anodization, electropolishing and the like may also be used in various manufacturing stages.

Generally, electrochemical deposition may be divided into "through-mask" deposition and blanket deposition, each regime requiring respective electrochemical process tools and strategies. For example, the copper damascene regime is presently one of the most important blanket deposition techniques, in which the metal is blanket-deposited above a patterned surface, while, after the deposition, excess material may be removed on the basis of planarization techniques, such as chemical mechanical polishing (CMP), electrochemical etching and the like, in order provide the isolated metal regions. A typical process representing the through-mask deposition regime, is the electrochemical deposition used for chip packaging. The process of forming solder bumps for directly connecting the solder bumps to respective solder pads of a carrier material is increasingly gaining in importance due to a plurality of advantages offered by this packaging technique. For example, increased input/output capability for the same chip area may be obtained compared to wire bonding in which the bond pads are substantially restricted to the periphery of the chip. The solder bumps are typically formed on an appropriate metallization layer stack, which may sometimes be referred to as underbump metallization, that provides the desired adhesion and electrical characteristics during the deposition process and during operation of the device. For example, titanium and tungsten may frequently be used in combination with copper and chromium for underbump metallization layers, wherein a substantially pure copper layer may be provided as the last layer, on which the solder material may be deposited to form a highly stable intermetallic compound upon re-flowing the deposited solder material. During the electrochemical deposition of the solder material, the underbump metallization layer may also act as a current distribution layer and a seed layer for the appropriate initialization of the electrochemical process. By forming a deposition mask, such as a resist mask, the deposition of the solder material may be restricted to well-defined locations on the underbump metallization, thereby also defining the lateral dimensions of the solder bumps. After the electro-chemical deposition of the solder material, the continuous underbump metallization layer has to be removed from dedicated locations in order to provide electrically isolated solder bumps. For this purpose, the copper-based metals of the underbump metallization layer may be efficiently removed on the basis of electrochemical etch techniques, while the adhesion layer, such as the titanium tungsten layer, may require sophisticated wet and/or dry chemical etch techniques.

The electrochemical removal of the copper material or other seed layers is, among other factors, one important aspect that determines the finally achieved uniformity of the solder balls after re-flowing the solder bumps. During the re-flow process, the copper-based material that has been maintained after the electrochemical etching process defines an island of wetting material for the liquid solder material, thereby also determining the lateral dimension and thus the height of the solder ball as well as the degree of adhesion. That is, during the re-flow process, the molten solder material forms a metallic compound with the copper-based wetting surface, wherein the corresponding process is substantially restricted to the area of the wetting surface, thereby creating a solder ball firmly connected to the wetting surface with a substantially round shape outside the wetting surface caused by gravity and the surface tension of the molten solder material. Hence, a precise definition of the lateral dimension of the wetting surface during the electrochemical etching process requires a precise and uniform degree of "undercut" during the etch process, in which the solder bump acts an etch mask.

Thus, the selective removal of the seed layer(s) of the underbump metallization requires accurate control of the uniformity of the removal rate within individual substrates and among a plurality of substrates in order to obtain a reliable electrical connection of the solder balls with respective solder pads of a package during chip packaging, since failure of one single solder ball/pad connection out of hundreds or thousands of connections may render the device non-operational.

One specific type of electrochemical etch tool is a reactor using jets of electrolyte and a scanning cathode of defined lateral dimensions that is moved relative to the substrate surface, thereby enhancing control of the removal rate. It has been recognized that the removal of material of the conductive seed layer across the entire substrate surface may result in moderate process non-uniformities, since layer portions located more closely to the current source may be removed more efficiently compared to remote layer portions, thereby possibly isolating remote areas and thus disconnecting the required current flow prior to completely removing these layer portions. By scanning a cathode of restricted dimensions across the substrate while supplying electrolyte solution between the gap formed between the scanning cathode and the surface to be etched, well-defined process conditions may be locally established on the basis of the gap distance, the scanning speed, the process voltage or current and the like, wherein the locally restricted process area may provide enhanced uniformity, reduced current capability required for the current source, increased process flexibility and the like, as for instance the scanning speed may be used as an efficient process parameter for adjusting the overall process performance of the electrochemical etch process.

For example, in some systems for electrochemical etching, a substantially rectangular etch bar or paddle may be moved in a linear motion across the surface to be etched, which is mounted in an appropriate substrate holder with the surface facing downward into a container for receiving electrolyte solution that is applied to the surface portion by means of respective openings provided on the moving cathode. The cathode may be attached to a drive assembly, which in some available systems comprises two linear motors formed on either side of the electrolyte container to define the linear scan path. The linear motors including a magnetic rail are connected to a common drive controller in order to achieve synchronous operation of the motors that is required to provide controllable and uniform motion of the etch paddle along the scan path. During operation of conventional systems, such as the one described above, the mechanical components of the drive assembly attached to the tool frame and thus to the container at the bottom area of the tool, such as guide rails, ball bearings and the like, may be contaminated by process fluids leaking through respective openings in the frame or container, thereby causing deterioration of the these components and resulting in increased process non-uniformities, since non-uniformity of the mechanical response of the drive assembly including the linear motors may result in a non-controlled etch rate during the scanning process. Thus, frequent maintenance activities and replacement of drive components may be necessary in order to maintain the overall yield loss within acceptable process limits. However, the tool utilization and overall process throughput may be considerably restricted in conventional electrochemical etch tools using a scanning electrode regime.

The present disclosure is directed to various methods and systems that may avoid, or at least reduce, the effects of one or more of the problems identified above.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

Generally, the present disclosure relates to the field of electrochemical processes, which are performed on the basis of process tools including a movable electrode assembly that is scanned across a substrate surface to be treated. For this purpose, a corresponding drive system is provided that is connected to the movable electrode assembly in order to precisely control the relative motion between the surface to be treated and the electrode assembly so as to establish the required electrolyte flow in combination with an appropriate electrical field for initiating the electrochemical treatment. To this end, the drive system is appropriately designed to provide a desired high range of scan speeds in accordance with process requirements to enable the coverage of a wide variety of process conditions. For example, in one illustrative aspect, the drive system is configured to be used in combination with a process tool for performing electrochemical etch processes, wherein one or more metallic layers have to be removed between respective bump structures formed on different product substrates involving a wide range of respective bump pitches, thereby requiring a high degree of flexibility in adapting the respective scan speed profile to each specific product type. Consequently, the drive system may comprise at least one electric motor providing the desired wide range of operating speeds in combination with the required torque in order to reliably drive the corresponding electrode assembly along the linear scan path with the required high degree of uniformity.

According to one illustrative embodiment, a drive system for a process tool for performing electrochemical processes comprises a frame configured to receive a substrate holder that is configured to hold in place a substrate at a predefined process position in an interior of the frame. Furthermore, the drive system comprises a movable electrode assembly configured to be scanned across the predefined process position along a linear scan path. Furthermore, a drive assembly is provided and has a rotating electric motor and a power transmission connected thereto, wherein the power transmission extends along an outer side-wall of the frame, while the drive assembly is connected to the movable electrode assembly. Finally, the drive system comprises a control unit connected to the electric motor, wherein the control unit is configured to drive the motor on the basis of a control regime for locally maintaining a predefined scan speed along the linear scan path.

According to another illustrative embodiment, a drive system for a process tool for performing electrochemical processes comprises a frame configured to receive a substrate holder that is configured to hold in place a substrate at a predefined process position in an interior of the frame. Furthermore, a movable electrode assembly is provided and is configured to be scanned across the predefined process position along the linear scan path. Moreover, a drive assembly has a first electric motor and a first power transmission connected thereto, wherein the first power transmission extends along a first outer side wall of the frame and is located above a height position of the substrate when the substrate is placed in the predefined process position. The drive assembly is connected to the movable electrode assembly. Furthermore, a control unit is connected to the first electric motor and is configured to drive the first electric motor on the basis of a control regime for locally maintaining a predefined scan speed along the linear scan path.

According to yet another illustrative embodiment, an electrochemical etch process tool for processing substrates of microstructure devices comprises a frame configured to receive a substrate and to hold the substrate in a predefined process position. The process tool further comprises a movable electrode assembly driven by a drive assembly comprising an electric motor and a power transmission train defining a linear scan path, wherein at least the power transmission train is positioned at a height level that is above the height level of the predefined process position.

BRIEF DESCRIPTION OF THE DRAWINGS

The disclosure may be understood by reference to the following description taken in conjunction with the accompanying drawings, in which like reference numerals identify like elements, and in which.

Figure 1A:
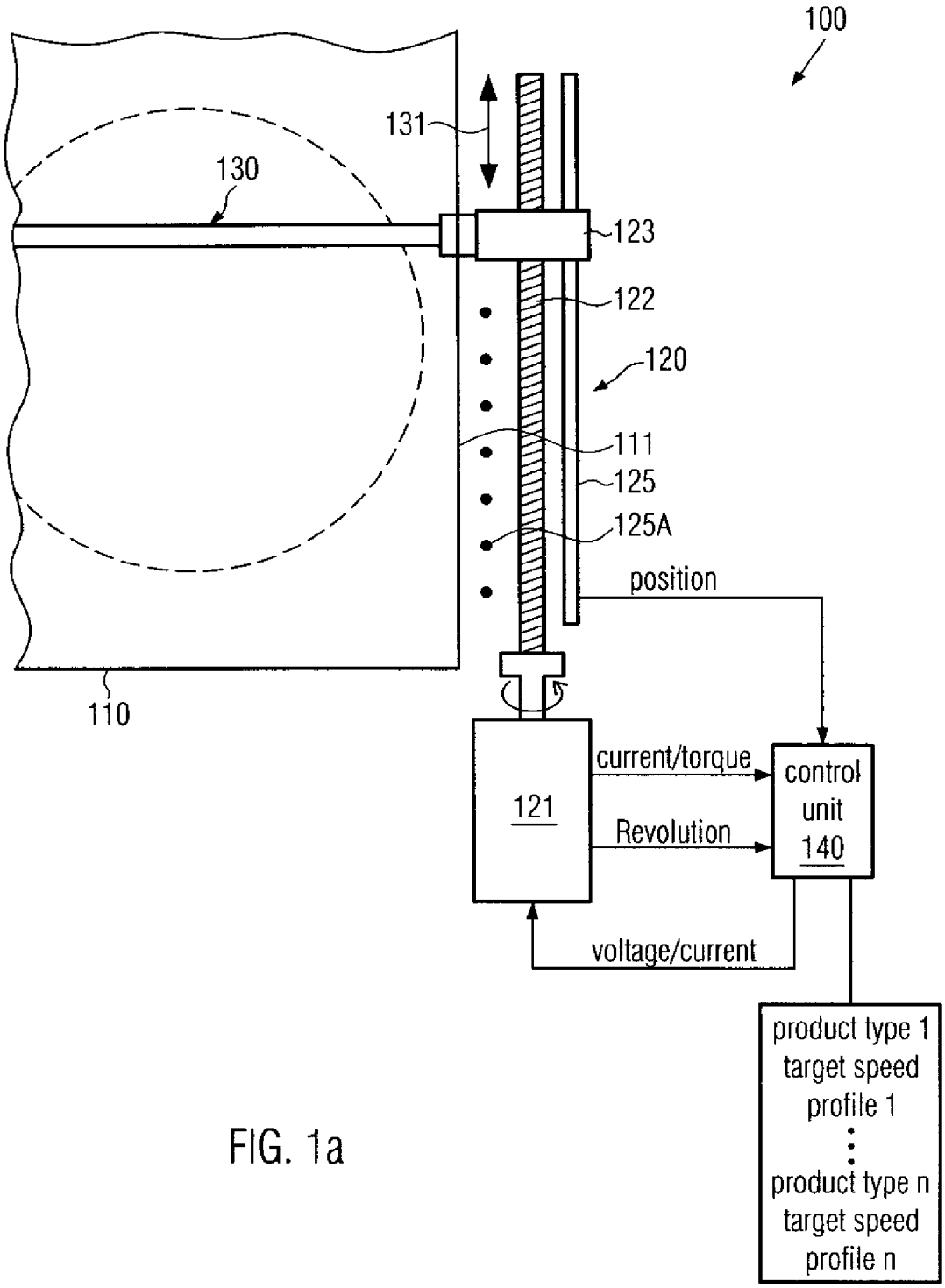
FIG. 1*a* schematically illustrates a drive system that may be used in combination with a process tool for performing electrochemical processes, such as an electrochemical etch process, on the basis of a linearly moved electrode assembly scanning the substrate surface to be treated, according to one illustrative embodiment disclosed herein.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Various illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

The subject matter disclosed herein relates to electrochemical processes in which a substrate surface is contacted with an electrolyte solution in order to initiate an electrochemical reaction for depositing or removing material from the substrate surface to be treated. In the embodiments described herein, the electrochemical process is initiated on the basis of a locally created electrical field that is scanned across the substrate surface according to a well-defined scan regime. For this purpose, a movable electrode surface, which, in some illustrative embodiments, may also provide the required electrolyte flow, may be scanned across the substrate surface according to a linear scan path, wherein, contrary to conventional electrode assemblies with linear motion, the probability for contamination of respective components of the drive assembly may be significantly reduced, thereby providing enhanced uniformity of the scan motion across the substrate surface. Furthermore, the drive assembly may provide a high degree of flexibility in adjusting the scan speed in accordance with a specified target scan speed profile, which may include a speed variation for single substrates in order to accommodate the varying degree of coverage of the movable electrode assembly with respect to the substantially disc-shaped substrate surface and/or which may also enable a wide range of possible scan speeds for a plurality of different substrate types, wherein each type may require a different target scan speed or a different target scan speed profile. Consequently, based on these enhanced design features, the performance with respect to substrate throughput of respective electrochemical process tools may be enhanced, since the tool utilization of respective electrochemical process tools may be determined by the degree of flexibility in implementing respective process recipes for a plurality of different product types, as are typically encountered in complex manufacturing environments of microstructure devices, such as integrated circuits. For example, a respective process chamber for an electrochemical treatment of substrate surfaces, which may accommodate every scan speed profile of any product type to be processed in the manufacturing environment, may have a positive effect on investment costs and thus overall production costs. Moreover, a high throughput of a respective process chamber may also positively contribute to reduced production costs, since less respective process chambers may have to be implemented into a corresponding tool frame, thereby reducing the degree of automation required within the tool frame, for instance with respect to substrate handling automation and the like. On the other hand, highly effective electrochemical process tools including high throughput process chambers may significantly suffer from throughput loss when corresponding maintenance and down times of the process tool may occur. Thus, the subject matter disclosed herein may also provide significant advantages with respect to process uniformity and reduction of maintenance and down times due to the enhanced configuration of the respective drive system, thereby significantly contributing to an overall increased production yield and throughput.

It should be appreciated that, in illustrative embodiments disclosed herein, an electrochemical etch process on the basis of a movable electrode assembly is referred to, in order to reliably remove respective metal layers from patterned surface areas, such as the removal of one or more seed layers or underbump metallization layers used for forming respective solder bumps, as previously explained, since, here, highly effective metal removal processes may be required at a high degree of process flexibility due to a varying distance of solder bumps within individual substrates and between different product types. Consequently, the corresponding drive systems and process tools may be advantageously applied to electrochemical etch processes and in particular embodiments for the definition of respective wetting surfaces of solder bumps. However, as previously explained, electrochemical processes may also include the deposition of metal material or may include a combination of metal deposition and metal removal, depending on the process requirements, wherein the corresponding deposition and/or removal environment may be provided at a restricted surface portion on the basis of a movable electrode assembly. Thus, unless otherwise specifically set forth in the specification or the appended claims, the present invention should not be construed as being restricted to electrochemical etch processes.

FIG. 1*a* schematically illustrates a drive system 100 that may be used in combination with an electrochemical process tool, which, in one illustrative embodiment, may represent a tool for performing electrochemical etch processes. The drive system 100 may comprise a frame 110 which may, in some illustrative embodiments, represent a mechanical structure to be attached to a respective reactor vessel or container of the electrochemical etch tool, while, in other illustrative embodiments, the frame 110 may be configured as a substantially container-like assembly for providing or receiving respective process fluids, such as electrolytes, de-ionized water and the like. Irrespective of the construction of the frame 110, the dimensions and the configuration may be selected such that a respective substrate holder (not shown) may be positioned in the interior of the frame 110 so as to hold in place a respective substrate 101, indicated by dashed lines, in a specific process position in order to define the controlled processing environment required for the treatment of the respective substrate surface. It should be appreciated that the frame 110 may be configured to receive substrates of any appropriate size, such as substrates having a diameter of 200 mm, 300 mm and even more, depending on the substrate size used in the corresponding manufacturing environment in which the drive system 100 is to be used. In other illustrative embodiments, the frame 110 may be configured such that different substrate sizes may be processed, since the drive system 100 may provide a high degree of process flexibility, for instance with respect to adapting respective scan speed profiles, energizing respective electrode portions and the like, in order to appropriately provide an electric field distribution at the surface of the substrate 101.

The drive system 100 may further comprise a movable electrode assembly 130 which may be provided in the form of a substantially rectangular assembly that may be moved along a substantially linear scan path 131, wherein, in some illustrative embodiments, the electrode assembly 130 may also be configured to provide respective process fluids, such as an electrolyte, water, gaseous components and the like, to the surface of the substrate 101. In some illustrative embodiments, the movable electrode assembly 130 may be designed such that the corresponding electric field and the electrolyte flow may be established in a substantially horizontal manner, i.e., the corresponding surface of the substrate 101 may be positioned above or below the movable electrode assembly 130. In one illustrative embodiment, as will be described later on in more detail, the electrode assembly 130 is movably arranged below the substrate 101 when positioned in the corresponding process position. As will be described later on in more detail, the movable electrode assembly 130 may comprise respective components, such as fluid manifolds, electrically conductive portions, respective connectors for connecting the assembly 130 to an external power source, respective connections for supplying required process fluids and the like. Furthermore, it should be appreciated that the substantially bar-shaped configuration of the assembly 130 is of illustrative nature only and other appropriate shapes may be used, as long as a desired fluid and electric field distribution may be established at the substrate surface during the movement along the scan path 131.

The drive system 100 may further comprise a drive assembly 120 which is mechanically connected to the movable electrode assembly 130, wherein the drive assembly 120 comprises at least one rotational electric motor 121 that provides the required mechanical power for generating the required scan speed profile along the scan path 131. For this purpose, the electric motor 121 is mechanically coupled to a power transmission train 122 which may be arranged along the scan path 131 at an outer sidewall 111 of the frame 110. In one illustrative embodiment, the power transmission may comprise a thread drive including a threaded rod that is rotatably connected to the electric motor 121 in order to convert a rotational motion into a substantially linear motion of a corresponding threaded member 123, which may additionally be attached to a respective guide rail (not shown) in order to provide precise linear motion. In some illustrative embodiments, the drive assembly 120 may be attached to the frame 110 at a height level that is above a height level defined by the process position of the substrate 101, as will be described later on in more detail. Thus, by providing a rotating electric machine as a drive source for the movable electrode assembly 130, a wide range of process torques and scan speeds may be accomplished due to the respective operational characteristics of electric motors. For instance, respective servo motors are available, providing a high torque over an extended range of rotational speeds, wherein, additionally, a high degree of controllability may be provided. For instance, respective brushless direct current (DC) motors, high performance DC motors and/or induction motors, of synchronous or asynchronous type, in combination with respective motor control units, may be used for the electric motor 121. Hence, the respective motor characteristics may be selected so as to accommodate the desired torque and speed range, without requiring the consideration of respective dimensions of the motor 121, since, contrary to conventional systems using linear motors, the electric motor 121 is stationary and may be attached with any appropriate size and weight outside the frame 110. Furthermore, the electric motor 121 may be provided with an appropriate housing in order to obtain a substantially encapsulated configuration which may thus provide a high resistance against contamination of internal components of the motor 121, thereby resulting in a high degree of reliability without significant maintenance activities. Furthermore, since the electric motor 121, as well as corresponding mechanical components of the entire drive assembly 120, may be positioned such that the probability for contamination by respective process fluids is significantly less compared to conventional systems including drive components positioned in the vicinity of respective openings for supplying process fluids, respective maintenance activities or replacement of mechanical components may be significantly reduced. Furthermore, robust materials, such as stainless steel and the like, may be efficiently used for the mechanical components of the power transmission 122, thereby also reducing any effect on the operational behavior of the drive assembly 120, even if a certain degree of contamination may occur.

In some illustrative embodiments, the drive assembly 120 further comprises a position sensor 125, which may provide a respective position signal indicative of the absolute position of the movable electrode assembly 130 along the scan path 131. In one illustrative embodiment, the position sensor 125 may comprise a corresponding system for determining the rotational speed of the motor 121 in combination with at least one component indicating at least one absolute position of the assembly 130. For instance, a precise encoder may be included in the electric motor 121 in order to precisely determine the angular position of the rotor, wherein one or more respective position sensors, such as inductive position sensors 125A, may provide an additional position signal when the electrode assembly 130 is positioned at the one or more sensors 125A. In this case, the at least one signal provided by the sensor 125A may indicate an absolute position for at least one specified scan position of the assembly 130, while the corresponding encoder may efficiently enable the substantially continuous monitoring of the corresponding movement and thus position of the electrode assembly 130 along the scan path 131. It should be appreciated that a corresponding encoder may not necessarily be provided as a separate component of the motor 121 but may instead be provided as an electronic control component using motor internal characteristics, such as induced phase voltages of non-powered phase coils in brushless DC motors, synchronous motors and the like. Similarly, the respective position sensors 125A may be omitted if other sensor signals may be generated in order to indicate at least one absolute position of the assembly 130. For instance, the scan path 131 may be mechanically restricted by a respective stop element and the like, wherein a corresponding sensor signal for a corresponding end position may be obtained on the basis of a respective torque or current signal provided by the electric motor 121. That is, when moving the assembly 130 to the respective end position, a corresponding increase of torque or current may be detected and may be used for indicating an absolute position of the assembly 130. In other illustrative embodiments, the position sensor 125 may comprise a corresponding sensor array arranged along the entire length or at least a significant portion of the scan path 131 in order to provide a position signal corresponding to the actual position of the electrode assembly 130, irrespective of any mechanical inaccuracies occurring in the drive assembly 120, such as a certain degree of slip and the like.

In one illustrative embodiment, a corresponding sensor element extending along the scan path 131 may be provided in the form of an inductive position sensor, which may comprise, for instance, appropriately shaped sensor tracks which may induce a position dependent voltage in a corresponding receiver element that is moved synchronously with the electrode assembly 130 along the corresponding scan path 131. By providing a substantially contact-free positioning system, which in some illustrative embodiments may be based on inductive position sensors, the overall robustness and thus reliability of the drive assembly 120 may be increased wherein, in particular, contamination-induced errors, as may occur in optical position sensors typically used in conventional position sensor systems, may have a significantly less effect on the operational behavior of the system 120.

The drive system 100 may further comprise a control unit 140 that is operatively connected to the electric motor 121 in order to provide a respective operating voltage and/or current to move the electrode assembly 130 in accordance with a desired scan speed or scan speed profile. For this purpose, the control unit 140 may have implemented therein, for instance in a corresponding memory device and the like, respective target data for generating appropriate control signals in order to adjust a respective operating voltage or current for the motor 121. In other cases, respective target values for the scan speed for various product types may be supplied to the control unit 140 by any external source, such as a supervising control system, an operator and the like. In some illustrative embodiments, the control unit 140 may also receive respective motor internal information, such as current, voltage and/or torque values presently used in the motor 121, the operational speed of the motor 121, i.e., the number of revolutions and the like, wherein this information may be used to determine the operational status of the motor 121 so as to appropriately actuate respective power switches, if, for instance, complex control schemes for brushless DC motors, synchronous motors, asynchronous motors, reluctance motors and the like are considered. As previously explained, the corresponding motor internal information may also be used for determining the momentary position of the assembly 130 and thus the momentary scan speed, which may therefore be compared with the respective target scan speed in order to appropriately adjust the motor voltage or current supplied to the motor 121. In other cases, the respective position signals provided by the position sensors 125 and/or 125A may be used for determining the current position and speed in order to estimate any deviation from the respective target values so as to provide a respective motor voltage or current in order to maintain the actual scan speed at the target scan speed, which may also vary according to the actual absolute position. That is, depending on the position of the electrode assembly 130 with respect to the substrate 101, the scan speed may be adapted to provide enhanced electric field uniformity resulting in an enhanced uniformity of the respective electrochemical process.

Figure 1B:
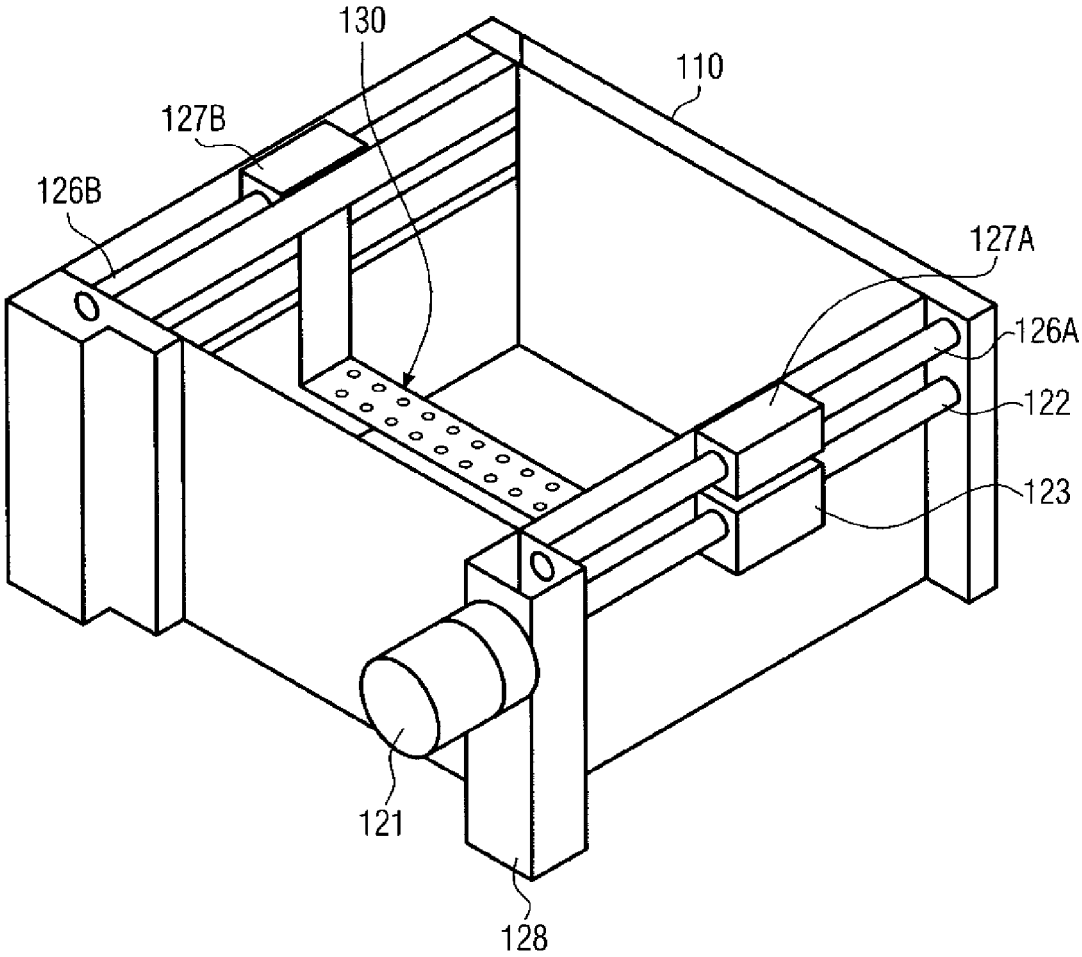
FIG. 1*b* schematically illustrates a perspective view of the frame and the corresponding drive assembly attached thereto of the drive system of FIG. 1*a* according to illustrative embodiments disclosed herein.

FIG. 1*b* schematically illustrates a perspective view of a portion of the drive system 100. As shown, the frame 110 may comprise the drive assembly 120 with the electric motor 121, which, in the embodiment shown, may represent the only drive source for moving the electrode assembly 130 along the scan path 131. In the embodiment shown, the power transmission 122 comprises the member 123, which in turn is connected to a corresponding member 126A that is movable along a guide rail 127A that provides precise linear movement of the members 123 and 126A. The member 126A in turn is mechanically connected to the electrode assembly 130, which is connected with a further member 127B movable along a corresponding guide rail 126B. Consequently, the single drive source, i.e., the motor 121, may provide the mechanical power to the electrode assembly 130 via the power transmission 122, 123 which, in turn, is precisely guided by the respective components 126A, 127A at one side of the frame 110 and by the respective components 127B, 126B provided at the opposite side of the frame 110. Furthermore, as illustrated, the corresponding mechanical components of the drive assembly 120 are provided at a height level that is above the corresponding exposed surface of the electrode assembly 130, which substantially determines a respective height position of a substrate to be treated, except for a corresponding gap formed between the electrode assembly 130 and the corresponding substrate surface. Hence, the probability for contaminating any of the mechanical components of the drive assembly 120 may be reduced, while at the same time high mechanical precision in combination with a wide range of operating conditions with respect to scan speed and torque may be provided.

Figure 1C:
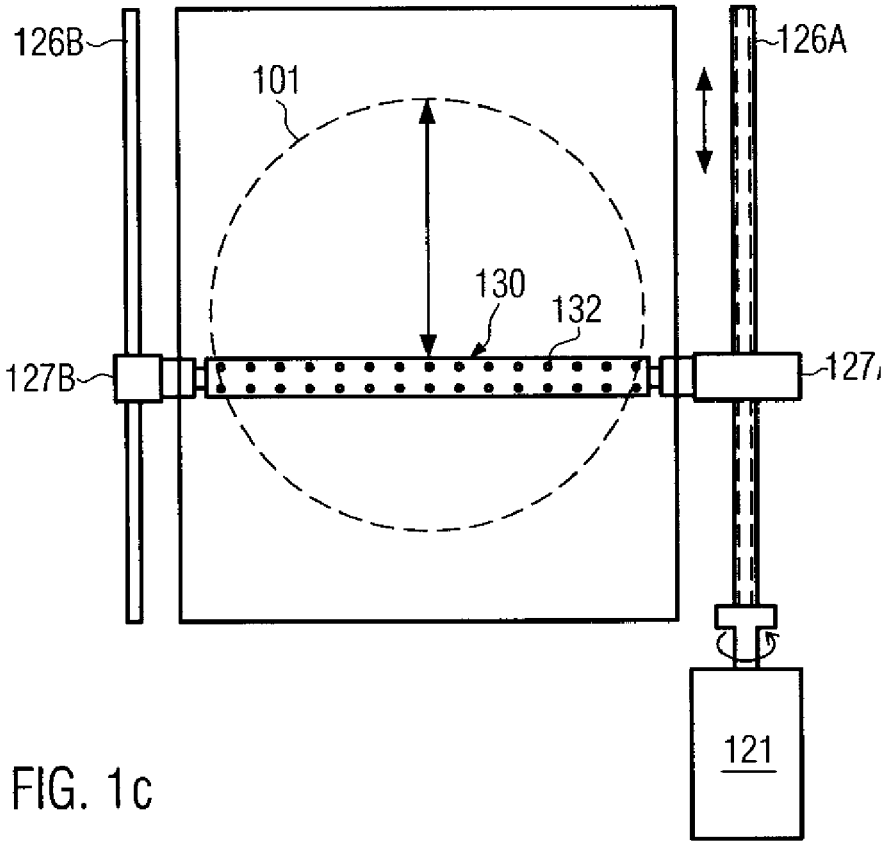
FIGS. 1*c*-1*d* schematically illustrate a top view and a cross-sectional view, respectively, of the frame including the drive assembly according to illustrative embodiments disclosed herein.

FIG. 1*c* schematically illustrates a top view of the portion of the drive system 100 as shown in FIG. 1*b*. As shown, the electrode assembly 130 may comprise a corresponding surface including respective fluid openings 132 in order to eject a respective electrolyte during scanning the electrode assembly 130 across the substrate 101, which has to be positioned above the electrode assembly 130. As is evident from FIG. 1*c*, a mechanically robust configuration may be obtained, wherein a single drive source, i.e., the motor 121, provides a highly uniform scan speed, since contamination of any mechanical component, such as ball-bearings provided in the respective members 127B, 127A and the like, may be significantly reduced. Furthermore, due to the rigid mechanical coupling of the members 127B and 127A to the electric motor 121, any increased mechanical resistance, even if occurring in a non-symmetric manner with respect to the components 126B, 127B and 126A, 127A, may be efficiently compensated for due to the wide operating range of the electric motor 121 with respect to torque and rotational speed. Hence, reliable operation of the drive system 100, even under sophisticated process conditions, may be accomplished, while, additionally, the momentary motor status for establishing the required scan speed profile may be used for diagnostic purposes in order to evaluate the operational status of the drive system 100. For instance, if an increased motor current may be required to obtain a specified scan speed, the control unit 140 may identify a corresponding contaminated state of mechanical components, while nevertheless ensuring a reliable continuous operation of the system 100, as long as the corresponding motor current required for compensating any increased mechanical resistances may be within the operational specifications of the electric motor 121 and the control unit 140.

Figure 1D:
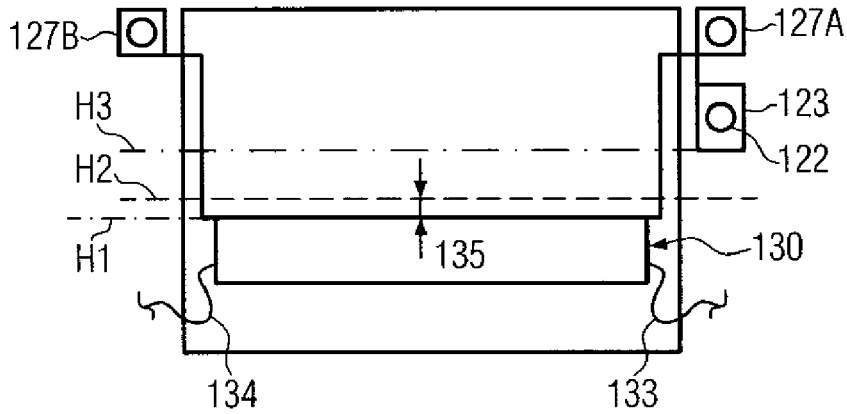

FIG. 1*d* schematically illustrates a cross-sectional view of the system 100 as shown in FIG. 1*b*, wherein the electrode assembly 130 is positioned with its upper surface including the corresponding openings 132 (FIG. 1*c*) at a first height level H1 that is less compared to a second height level H2 corresponding to a surface of a substrate when positioned in the corresponding process position. That is, the electrode assembly 130 and a corresponding substrate when positioned at the height level H2 define a corresponding process gap 135, in which the electrolyte flow and the corresponding electric field are established during operation of a respective process tool when the electrode assembly 130 is scanned across the substrate. Thus, respective process fluids may be provided to the assembly 130 via respective supply lines 133, 134 and may remain at a lower portion of the frame 110 during processing of a substrate, thereby significantly reducing the probability for contaminating any mechanical components of the drive assembly 120, since the respective components are arranged at a third height level H3 above the corresponding height levels H1, H2 which substantially correspond to regions at which the presence of chemicals may be most likely during the corresponding electrochemical process.

Figure 1E:
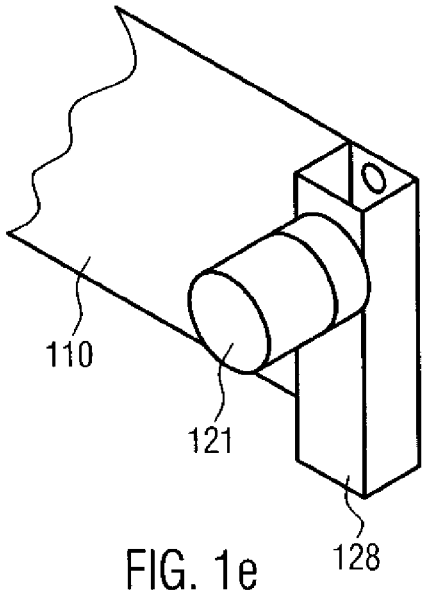
FIG. 1*e* schematically illustrates an electric high torque motor attached to the frame without contacting the interior of the frame according to one illustrative embodiment.

FIG. 1*e* schematically illustrates a perspective view of the electric motor 121 attached to the frame 110 by an appropriate support 128, wherein this configuration provides, in addition to a reduced probability for contamination by chemicals, enhanced flexibility in selecting an appropriate drive source, since the dimensions of the electric motor 121 may be less critical compared to conventional strategies in which linear motors may have to be provided within the respective rail system. Thus, any appropriate power, operational speed and torque may be provided by correspondingly selecting an appropriate electric motor which may be connected to the power transmission 122 by a respective mechanical coupling and/or by a further gear transmission and the like.

Figure 1F:
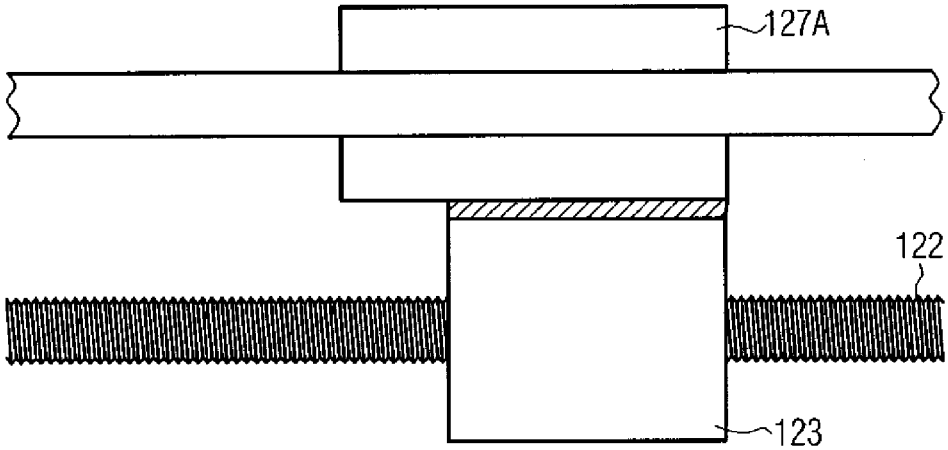
FIG. 1*f* schematically illustrates a detailed view of a portion of the power transmission train and a rail system for connecting to the movable electrode assembly according to illustrative embodiments disclosed herein.

FIG. 1*f* schematically illustrates a portion of the power transmission 122 and the corresponding member 127A connected thereto. As is evident from FIG. 1*f*, the rotational movement provided by the thread drive 122 may be efficiently converted into a linear motion by the member 123, which is connected and thus guided by the member 127A in order to provide a linear motion with low mechanical resistance and minimal mechanical slip.

Figure 1G:
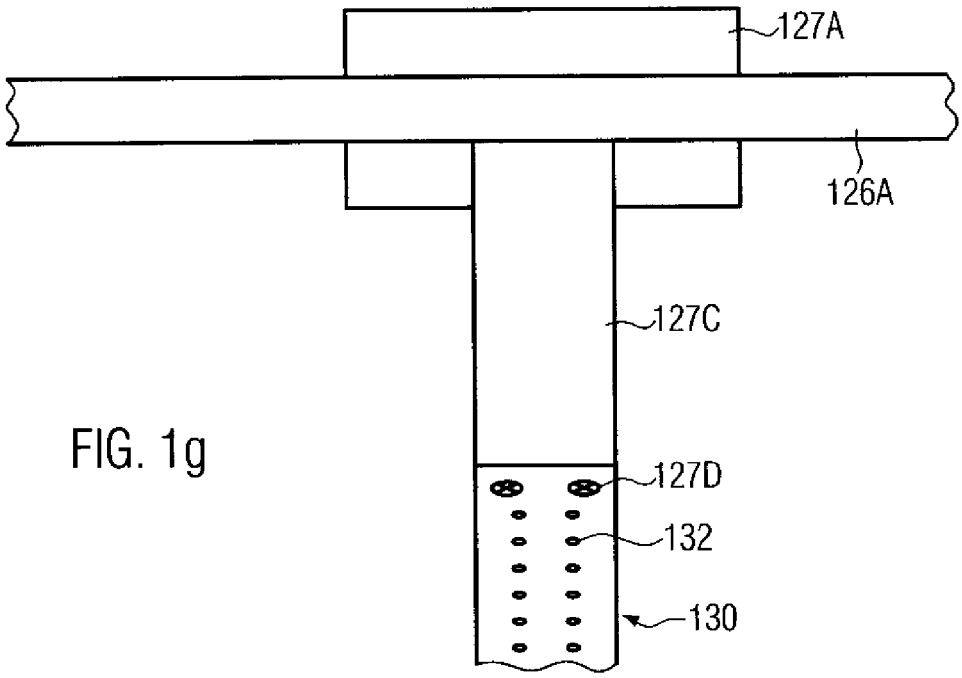
FIG. 1*g* schematically illustrates a member connected to a guide rail and comprising a continuous portion for connecting to the movable electrode assembly according to other illustrative embodiments disclosed herein.

FIG. 1*g* schematically illustrates a perspective view of the member 127A including a respective portion 127C, which may be provided in the form of a substantially continuous piece of material without respective connecting parts, such as bolts and screws, thereby providing a high degree of mechanical rigidness, which in turn translates into a highly uniform motion of the electrode assembly 130, which is connected to the member 127A and the respective continuous portion 127C by a corresponding contact section 127D. As shown, the electrode assembly 130 may be secured to the contact section 127D by means of appropriate elements, such as screws and the like.

Figure 1H:
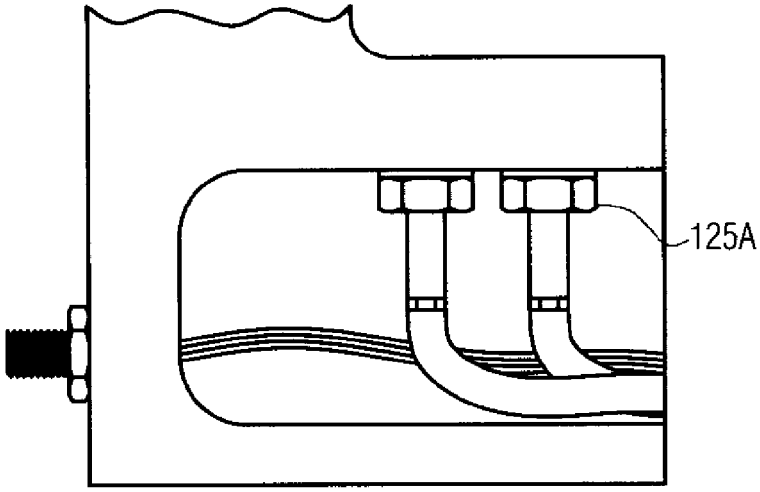
FIG. 1*h* schematically illustrates an inductive position sensor system according to further illustrative embodiments disclosed herein.

FIG. 1*h* schematically illustrates one or more inductive position sensors, such as the position sensors 125A (FIG. 1*a*), in which the absolute position along the scan path 131 may be detected, at least at one specific position, wherein a substantially continuous tracking of the electrode assembly 130 may be established on the basis of corresponding techniques, as previously described with reference to FIG. 1*a*.

The operation of the drive system 100 as illustrated in FIGS. 1*a*-1*g* will be described with reference to FIGS. 2*a*-2*b* when referring to a corresponding electrochemical etch tool including a drive system in accordance with an illustrative embodiment disclosed herein.

Figure 2A:
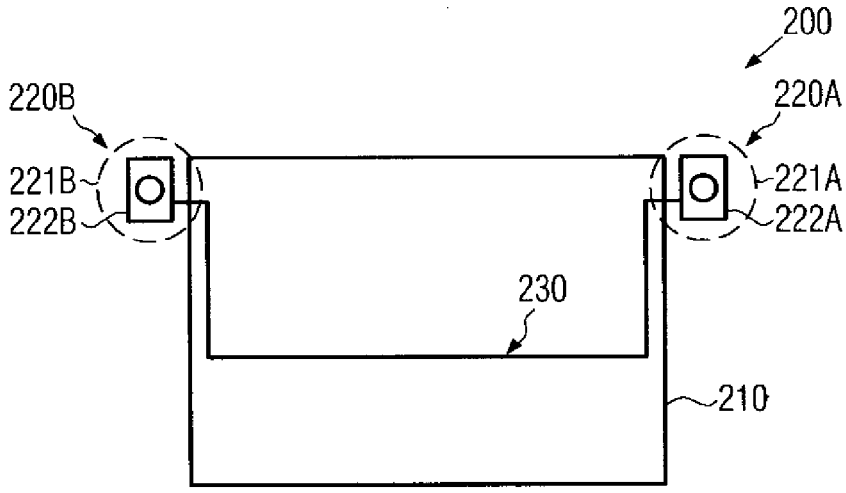
FIGS. 2*a*-2*b* schematically illustrate a cross-sectional view and a top view, respectively, of a frame including a drive assembly according to yet other illustrative embodiments disclosed herein.

FIG. 2*a* schematically illustrates a drive system 200 according to still further illustrative embodiments. Here, a respective frame 210, which may have the same configuration as previously described with respect to the frame 110, may be connected to a drive assembly 220 including a first part 220A and a second part 220B. The first and second parts 220A, 220B may have a substantially symmetric configuration and may each include a respective electric motor 221A, 221B connected to corresponding power transmissions 222A, 222B. The respective parts 220A, 220B may be connected to a corresponding control unit (not shown) which may be configured to appropriately control the respective motors 221A, 221B in order to provide a substantially uniform scan speed of the electrode assembly 230 according to a specified target scan speed or target scan speed profile. Furthermore, in the embodiment shown, the respective power transmissions 222A, 222B may be configured to convert the rotational speed of the motors 221A, 221B in a linear motion, as is previously described with respect to the power transmission 122. It should be appreciated that corresponding guide rails, such as the guides 126, 127, may also be incorporated in the respective power transmissions 222A, 222B. As is evident, the respective parts 220A, 220B of the drive assembly are located at a height position that is significantly above a corresponding height position defined by the electrode assembly 230, thereby also reducing the probability for any contamination by process chemicals, as is previously described.

Figure 2B:
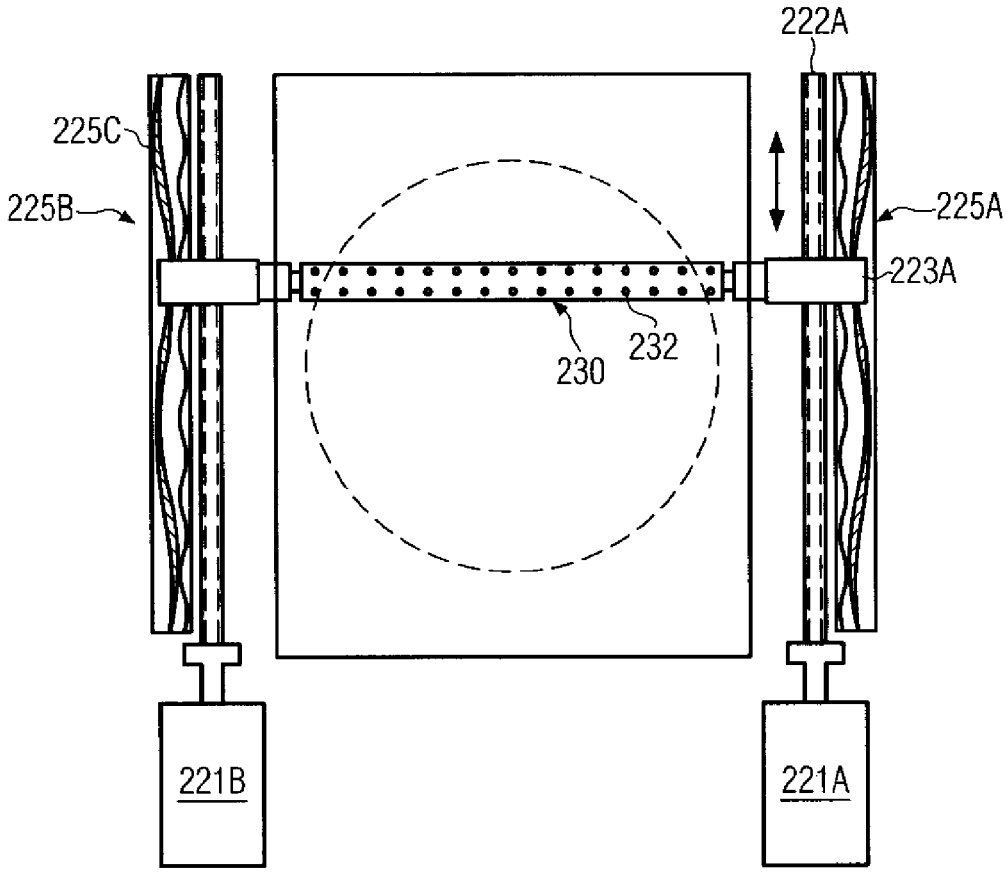

FIG. 2*b* schematically illustrates a corresponding top view of the drive system 200, wherein each of the drive assemblies 220A, 220B may comprise a corresponding position sensor 225A, 225B. As previously explained with respect to the position sensors 125, 125A, the motors 221A, 221B, in combination with additional sensor elements, may be used to obtain respective position information, or dedicated absolute position sensors, for instance in the form of respective tracks 225C for modifying a position-dependent induced voltage of a member moved together with the electrode assembly 230, wherein the corresponding induced voltages may indicate the absolute position of the electrode assembly 230, that is, of each portion connected to the respective members 223A, 223B. For example, the corresponding tracks 225C provided in the position sensors 225A may result in a corresponding induced voltage of a corresponding receiver element, wherein the induced voltage may have encoded therein the required position information, which is thus provided in a substantially contact free and hence reliable manner. In this way, the actual position of the members 223A, 223B, and thus of the respective portions of the electrode assembly 230 connected thereto at both sides of the frame 210, may be precisely determined and may be used for appropriately controlling the respective motors 221A, 221B. Thus, a reliable and uniform motion of the electrode assembly 230 may be obtained, irrespective of the width of the frame 210, i.e., the dimension perpendicular to the scan direction, thereby providing a high degree of flexibility with respect to processing substrates of large diameter, such as 300 mm substrates, 450 mm substrates and the like. Furthermore, providing at least the two parts 220A, 220B for creating the corresponding linear motion of the electrode assembly 230 may enable independent detection of mechanical deviations at respective sides of the electrode assembly 230, which may be caused by contamination, degradation of mechanical components and the like. For example, as previously explained, the respective motor status may be evaluated so as to estimate the mechanical resistance encountered in the respective power transmission 222A, 222B, thereby providing valuable diagnostic information with respect to the mechanical status of the drive assembly, while nevertheless providing the possibility of appropriately compensating for the occurrence of non-symmetric mechanical resistances. That is, especially for substrates of large diameter, the length of the corresponding scan path, as well as the length of the electrode assembly 230, may result in different and varying mechanical forces acting on the various parts 220A, 220B along the entire scan path. Furthermore, the torque required for the respective target scan speeds may be substantially divided by two, while nevertheless each of the motors 221A, 221B may have sufficient resources for individually compensating a variation of the mechanical resistance encountered at the individual power transmissions 222A, 222B thereby providing a highly synchronous motion. Consequently, a wide range of operating conditions may be provided with a reduced size of the individual electric motors, while the respective individually provided positional information, as well as the individual motor status analysis, may offer enhanced diagnosis capabilities with respect to the overall status of the drive system 200.

Figure 3A:
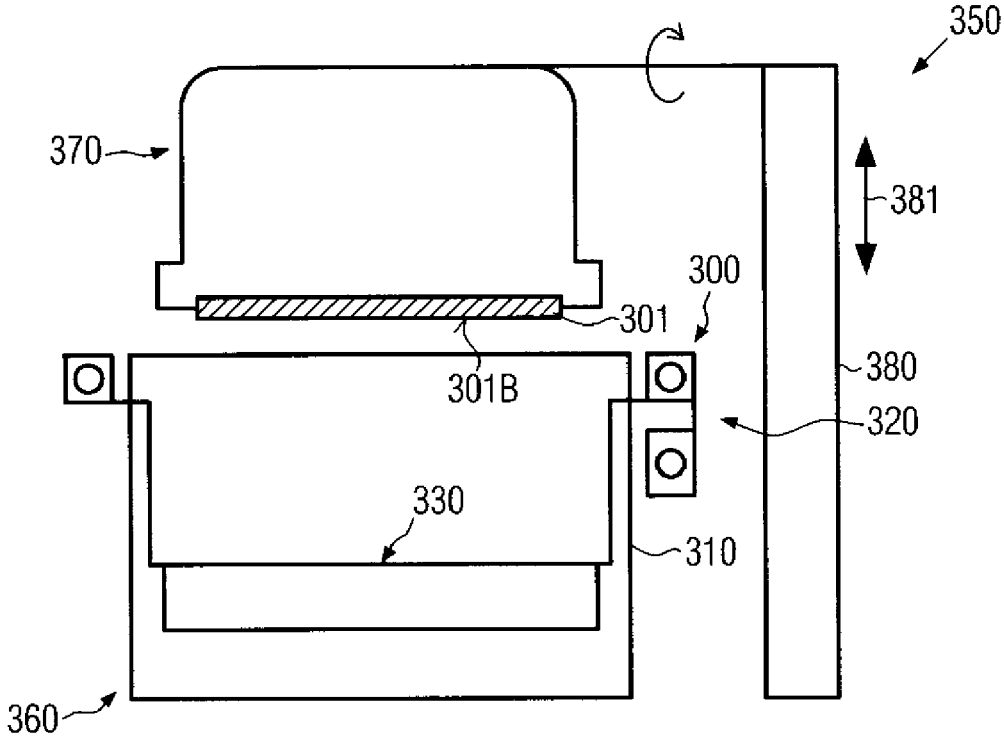
FIGS. 3*a*-3*b* schematically illustrate a process tool used for the electrochemical treatment of substrates for forming thereon and therein microstructure devices, wherein a drive system may be used.

FIG. 3*a* schematically illustrates a process tool 350 for performing electrochemical processes on an exposed surface 301B of a substrate 301 that, in one illustrative embodiment, represents a substrate for forming thereon and therein microstructure devices, such as integrated circuits and the like. The process tool 350 may comprise a reactor 360 and a reactor head assembly 370 that is connected to a lift mechanism 380 configured to drive the reactor head assembly 370 vertically, as indicated by arrow 381. For example, the lift mechanism 380 may drive the head assembly 370 into a first position in which the substrate 301 may be received by the assembly 370, for instance on the basis of appropriate robot handling systems and the like. For convenience, any such transport mechanisms for loading or unloading the substrate 301 to and from the head assembly 370 are not shown in FIG. 3*a*. The reactor 360 may comprise a drive system 300 which may include a movable electrode assembly 330 connected to a corresponding drive assembly 320, which in turn is attached to a corresponding frame 310. The drive system 300 may be configured as is previously described with respect to the drive assemblies 100 and 200. Hence, the drive system 300 may provide enhanced reliability and flexibility due to the corresponding configuration, such as elevated height position of respective mechanical components and the like, as previously described.

During operation of the process tool 350, the substrate 301 may be loaded onto the head assembly 370 when positioned in a corresponding load position, wherein a corresponding mechanical attachment may be accomplished on the basis of vacuum or end effectors contacting the substrate 301 at an edge region thereof and the like. Thereafter, the lift mechanism 380 may be operated to lower the reactor head assembly 370 into the reactor 360.

Figure 3B:
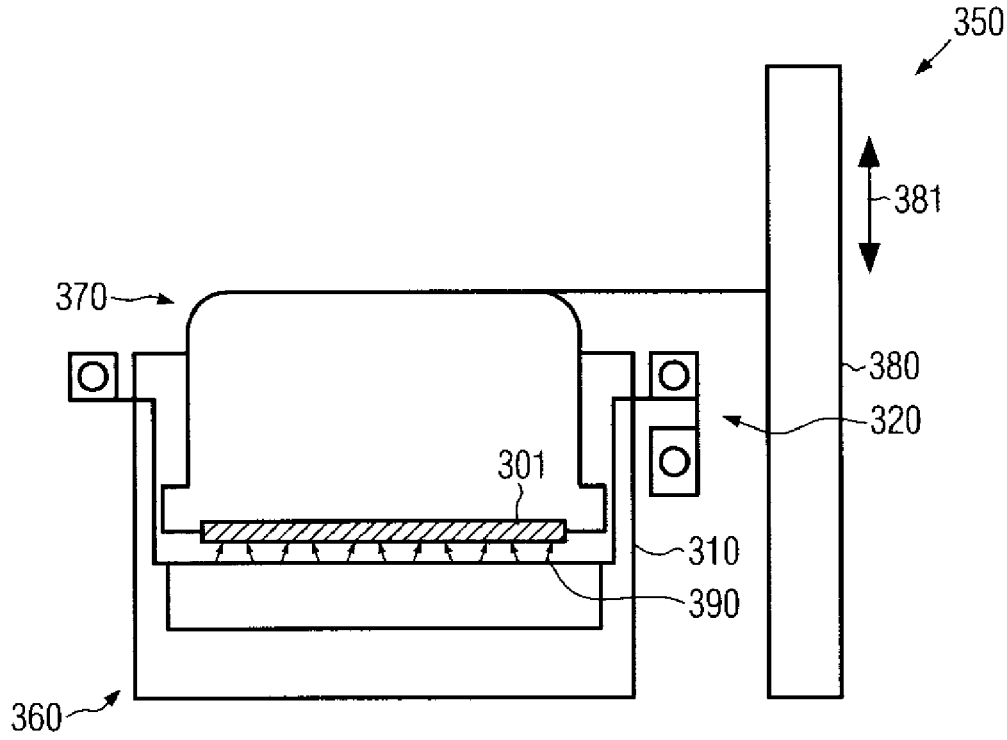

FIG. 3*b* schematically illustrates the process tool 350 when the reactor head assembly 370, and thus the substrate 301, is positioned at a corresponding process condition which provides the appropriate process environment initiating the actual electrochemical process. Thus, as shown, in the process position, the substrate surface 301B is located at a height level that is lower compared to a corresponding height level at which respective components of the drive assembly 320 are positioned. Consequently, during the further processing of the substrate 301, the probability of contamination by chemicals may be reduced. Furthermore, when initiating the electrochemical process, a corresponding electrolyte 390 is provided into a gap 391 defined between the electrode assembly 330 and the surface 301B. That is, the corresponding gap 391 is defined by the surface portion 301B opposite the respective surface area of the electrode assembly 330. The electrolyte 390 may be supplied on the basis of appropriate supply mechanisms involving respective supply lines, pumps, etc. which, for convenience, are not shown in FIG. 3*b*. As previously explained, respective fluid manifolds and openings may result in a substantially uniform electrolyte flow from the electrode 330 to the surface 301B. During supplying of the electrolyte 390, a corresponding current flow may also be established by connecting the electrode assembly 330 and the substrate surface 301B to a corresponding current source, wherein, for an electrochemical etch process, the electrode 330 may act as a cathode, while the substrate surface 301B may act as an anode, the material of which may be consumed, i.e., dissolved into the electrolyte 390, as previously explained. Furthermore, the drive system 300 may provide an appropriate scan speed along the scan path, wherein the corresponding scan uniformity may directly translate in a corresponding uniformity of the removal rate at a corresponding substrate area presently covered by the electrode assembly 330. Due to the enhanced mechanical construction and the superior control mechanism of the drive system 300, which may have the same configuration as previously described with reference to the drive systems 100 and 200, an enhanced etch behavior may be achieved.

In one illustrative embodiment, the surface 301B may represent a metal surface of a semiconductor substrate, wherein a plurality of solder bumps are formed on a respective underbump metallization layer, a portion of which may have to be removed on the basis of an electrochemical etch process. Consequently, the corresponding process uniformity may have a significant influence on the size of the corresponding wetting areas remaining under the corresponding solder bumps, which in turn may substantially determine the finally obtained size after reflowing the corresponding solder bumps. Thus, due to the enhanced controllability of the electrochemical etch process for removing undesired portions of the underbump metallization layer, the finally obtained height uniformity of the resulting solder balls may be efficiently enhanced, thereby reducing yield loss at a very late manufacturing stage of corresponding semiconductor devices. Furthermore, the high reliability of the corresponding drive system 300 may provide enhanced throughput and tool availability, since corresponding maintenance periods may be significantly reduced compared to conventional systems, while at the same time an enhanced range of operational conditions may be accommodated by a single process tool. For example, different product types typically require different bump architectures at the corresponding contact level, which may in turn require significantly different scan speed profiles, which may be efficiently provided by the tool 350*m* due to the possibility of using high torque electric motors compared to respective linear motors typically having a reduced range of torque and scan speed. Furthermore, the corresponding mechanical components may have a significantly enhanced reliability, thereby also resulting in reduced maintenance efforts, which may directly affect production costs.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A drive system for a process tool for performing electrochemical processes, the drive system comprising:

a frame that is adapted to receive a substrate holder, wherein said substrate holder is adapted to hold in place a substrate at a predefined process position in an interior of said frame at a substrate height level;

a movable electrode assembly that is adapted to be scanned across said predefined process position along a linear scan path and in a substantially horizontal plane;

a drive assembly connected to and adapted to move said movable electrode assembly, wherein said drive assembly comprises an electric motor and a power transmission apparatus operatively coupled to said electric motor, wherein said power transmission apparatus is positioned at a first height level and extends along one outer sidewall of said frame, and wherein said first height level is above said substrate height level; and a control unit operatively coupled to said drive assembly, wherein said control unit is adapted to control movement of said movable electrode assembly along said linear scan path.

2. The drive system of claim 1, wherein said drive assembly comprises a first guide coupled to said power transmission and a second guide attached to another sidewall of said frame.

3. The drive system of claim 2, wherein said power transmission comprises a thread drive coupled to said electric motor.

4. The drive system of claim 2, wherein said drive assembly comprises a first member coupled to said first guide and a second member coupled to said second guide, said first and second members being attached to said movable electrode assembly.

5. The drive system of claim 4, wherein each of said first and second members comprise a guide portion, a contact portion connecting to said movable electrode assembly, and a continuous connection portion between said guide portion and said contact portion, wherein said guide portion of each of said first and second members is adapted to move along said respective guide.

6. The drive system of claim 1, further comprising a position sensor that is adapted to determine an absolute position of said movable electrode along said scan path.

7. The drive system of claim 6, wherein said position sensor comprises an inductive position transducer.

8. The drive system of claim 6, wherein said control unit is further adapted to control said drive assembly based on a position signal obtained from said position sensor.

9. The drive system of claim 1, wherein said movable electrode assembly comprises a fluid supply surface that is adapted to supply an electrolyte to a substrate surface when moving along said linear scan path.

10. The drive system of claim 1, wherein said control unit is adapted to locally maintain a predefined scan speed of said movable electrode assembly during said movement.

11. A drive system for a process tool for performing electrochemical processes, the drive system comprising:

a frame that is adapted to receive a substrate holder, wherein said substrate holder is adapted to hold in place a substrate at a predefined process position in an interior of said frame at a substrate height level;

a movable electrode assembly that is adapted to be scanned across said predefined process position along a linear scan path and in a substantially horizontal plane;

a drive assembly connected to said movable electrode assembly, wherein said drive assembly is adapted to move said movable electrode assembly and comprises:

a first electric motor and a first power transmission apparatus operatively coupled to said first electric motor, wherein said first power transmission apparatus is positioned at a first height that is above said substrate height level and along a first outer sidewall of said frame; and a second electric motor and a second power transmission apparatus operatively coupled to said second electric motor; wherein said second power transmission apparatus is positioned at a second height above that is above said substrate height level and extends along a second outer sidewall of said frame; and a control unit operatively coupled to said drive assembly, wherein said control unit is adapted to control movement of said movable electrode assembly along said linear scan path.

12. The drive system of claim 11, further comprising a first position sensor and a second position sensor, said first and second position sensors being positioned along said first and second outer sidewalls so as to determine an absolute position of a first portion of said movable electrode assembly connected to said first power transmission apparatus and of a second portion of said movable electrode assembly connected to said second power transmission apparatus.

13. The drive system of claim 12, wherein said control unit is configured to control said first and second electric motors based on a first position signal obtained from said first position sensor and a second position signal obtained from said second position sensor.

14. The drive system of claim 11, wherein at least one of said first and second electric motors is a rotating electric motor.

15. The drive system of claim 14, wherein at least one of said first and second power transmission apparatuses comprises a thread drive assembly.

16. The drive system of claim 11, wherein said control unit is adapted to locally maintain a predefined scan speed of said movable electrode assembly during said movement.

17. An electrochemical etch process tool for processing substrates of microstructure devices, said etch tool comprising:

a frame that is adapted to receive a substrate and to hold said substrate in a predefined process position; and a movable electrode assembly driven along a linear scan path and in a substantially horizontal plane by a drive assembly comprising an electric motor and a power transmission train that is operatively coupled to said electric motor, wherein said power transmission train defines said linear scan path and is positioned at a height level that is above a height level of said predefined process position.

18. The electrochemical etch process tool of claim 17, further comprising an inductive position sensor that is adapted to provide a position signal that indicates a position of said movable electrode assembly, and a control unit operatively coupled to said electric motor and said position sensor, wherein said control unit is adapted to control said electric motor on the basis of said position signal.

19. The electrochemical etch process tool of claim 17, further comprising an additional electric motor operatively coupled to said power transmission train.

* * * * *